US005701549A

United States Patent [19]

Portig et al.

[11] Patent Number: 5,701,549

[45] Date of Patent: Dec. 23, 1997

[54] IMAGE FORMING APPARATUS WITH MODULAR STAGING ASSEMBLY

[75] Inventors: Harald Portig, Versailles; Kevin Dean Schoedinger, Nicholasville; Richard Andrew Seman, Jr.; Phillip Byron Wright, both of Lexington, all of Ky.

[73] Assignee: Lexmark International, Inc., Lexington, Ky.

[21] Appl. No.: 589,768

[22] Filed: Jan. 22, 1996

[51] Int. Cl.[6] ..... G03G 15/00

[52] U.S. Cl. ..... 399/36; 399/167

[58] Field of Search ..... 399/36, 37, 110, 399/167, 107, 388, 397, 411

[56] References Cited

U.S. PATENT DOCUMENTS

| | | | |
|---|---|---|---|
| 3,517,921 | 6/1970 | Miciukiewicz | 271/8.1 |
| 4,766,467 | 8/1988 | Yamada et al. | 399/110 |
| 5,278,623 | 1/1994 | Kasahara et al. | 399/394 |
| 5,298,958 | 3/1994 | Takahasi | 399/43 |
| 5,355,206 | 10/1994 | Maruyama et al. | 399/396 |
| 5,357,231 | 10/1994 | Miwa et al. | 399/36 |
| 5,408,304 | 4/1995 | Serizawa | 399/381 |
| 5,418,604 | 5/1995 | Nagakura et al. | 399/16 |
| 5,426,497 | 6/1995 | Morganti et al. | 399/394 |
| 5,440,382 | 8/1995 | Suga | 399/394 |
| 5,561,496 | 10/1996 | Sugiura et al. | 399/107 |

*Primary Examiner*—S. Lee

*Attorney, Agent, or Firm*—Ronald K. Aust

[57] ABSTRACT

A staging assembly for use in an image forming apparatus. The image forming apparatus includes a paper feed assembly having a plurality of rollers for feeding a transfer sheet to an electrophotographic assembly. A removable idler gear is interposed between the paper feed assembly and the electrophotographic assembly, and drives the paper feed assembly when installed. A staging assembly drives the paper feed assembly when the idler gear is removed and includes a rotatable drive element for connection to and rotation of one of the rollers; a drive unit for rotatably driving the rotatable drive element; and an electrical connector for electrically connecting the staging assembly to the electrophotographic assembly. The staging assembly is a modular assembly which is connectable to and removable from the paper feed assembly.

29 Claims, 5 Drawing Sheets

IMAGE FORMING APPARATUS WITH MODULAR STAGING ASSEMBLY

BACKGROUND OF THE INVENTION

1. Field of the Invention

The present invention relates to an electrophotographic image forming apparatus, and, more particularly, to an electrophotographic image forming apparatus having a paper feed assembly with a staged control of transfer sheets therethrough.

2. Description of the Related Art

Image forming apparatus of conventional design typically include an electric motor which is connected via appropriate gearing to both a photosensitive element, such as a photosensitive drum, of an electrophotographic (EP) assembly and the feed rollers of a paper feed assembly. Operation of the electric motor causes a predetermined rotation of each of the drum and the feed rollers. Typically, since both the feed rollers and the drum are connected to the common motor, a page which is picked from a paper source such as a paper tray must be transported through the paper feed assembly and the EP assembly.

It is also known to use a clutch which is interposed between the electric motor and the feed rollers of the paper feed assembly. A single motor still drives both the drum and the feed rollers; however, the feed rollers may be intermittently disengaged from the motor using the clutch. This allows a page to be transported in the input paper path of the feed rollers and stopped at a predetermined point while the EP assembly is forming a toned image on the previous page. Such "staging" increases the through-put rate of the image forming apparatus by moving the page closer to the EP assembly before being transported into the EP assembly.

A problem with a conventional image forming apparatus employing staging is that a particular model is either manufactured with or without staging. The clutch and gearing of conventional staging does not allow such staging to be inserted into a base model which was previously assembled without staging. This requires that two separate sets of drive trains having either common or dedicated motor systems be used dependent on whether a particular model is to be sold with or without staging, thereby increasing inventory costs. Moreover, a user which initially selects a model without staging cannot easily convert over to the same model which employs staging.

What is needed in the art is an image forming apparatus which allows a single drive train to be easily modified to include a staging option.

SUMMARY OF THE INVENTION

The present invention provides an image forming apparatus including a modular staging assembly. The staging assembly may be removably installed in a number of different image forming apparatus, and may be controlled using an electrical processor of the EP assembly to match the operating parameters of the particular image forming apparatus.

The invention comprises, in one form thereof, a staging assembly for use in an image forming apparatus. The image forming apparatus includes a paper feed assembly having a conveying mechanism, such as a plurality of rollers, for feeding a transfer sheet to an electrophotographic assembly. The staging assembly includes a drive unit for connection to and rotation of the conveying mechanism; and an electrical connector for electrically connecting the staging assembly to the electrophotographic assembly. The staging assembly is a modular assembly which is connectable to and removable from the paper feed assembly.

An advantage of the present invention is that a drive train in the image forming apparatus can be easily modified to incorporate a staging option.

Another advantage is that the staging option may be installed and used in a particular model which employs multiple through-put rates, or indifferent models which employ different through-put rates.

Yet another advantage is that only a single idler mechanism, such as a gear, need be removed from the drive train to separate the EP assembly from the feed rollers of the paper feed assembly.

A still further advantage is that the gears in the paper feed assembly need not be differently sized to effect a proper feeding of the page therethrough when the staging assembly is installed.

Another advantage is that the staging assembly can be installed into the imaging forming apparatus either at the time of manufacture, or at any time subsequent thereto.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
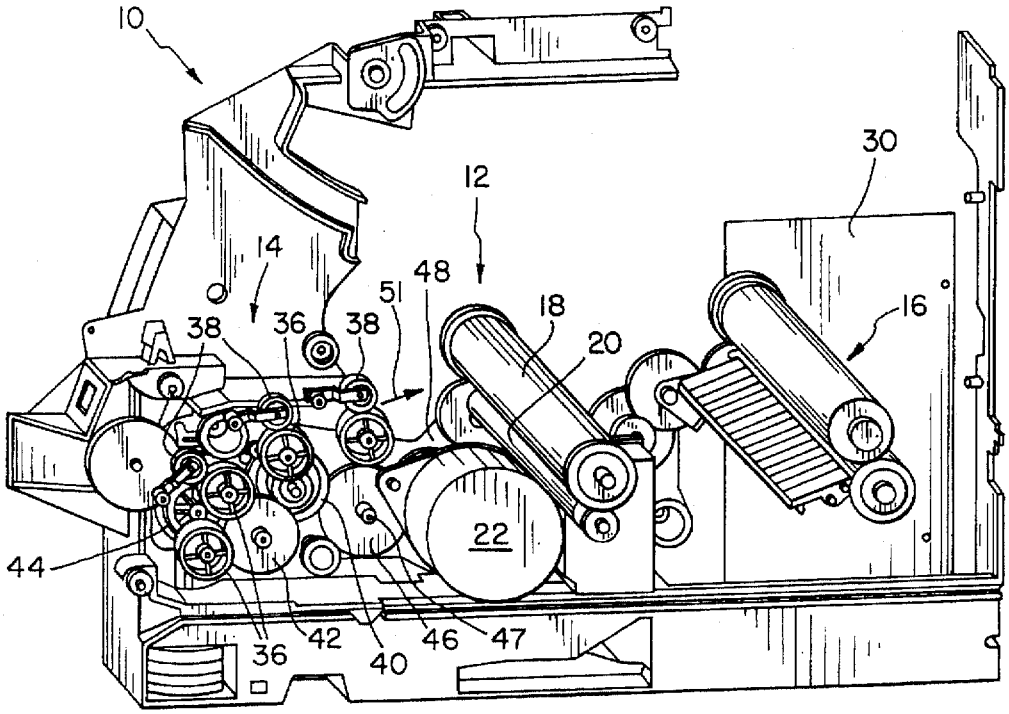
FIG. 1 is a perspective view of an embodiment of an image forming apparatus of the present invention, in which a staging assembly of the present invention may be installed.
Figure 2:
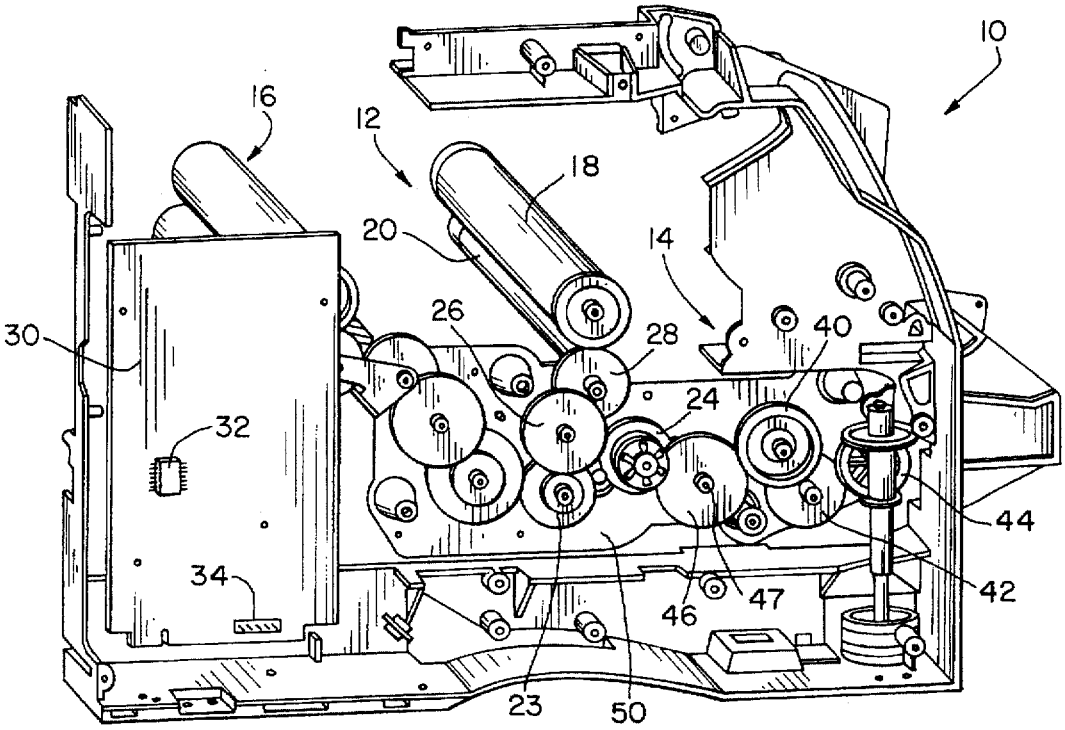
FIG. 2 is another perspective view of the image forming apparatus of FIG. 1.

Referring now to the drawings and particularly to FIGS. 1 and 2, there is shown an embodiment of an image forming apparatus 10 of the present invention, including an EP assembly 12, a paper feed assembly 14, and a fuser 16. The gears, rollers, etc., are shown for the purposes of illustration in simplified form without much of the attendant framework, bearings, etc., that are necessary for carrying the same. However, it will be understood by those skilled in the art that such structure is also necessary.

EP assembly 12 includes a photosensitive drum 18 which is disposed in association with a transfer roller 20. EP assembly 12 also includes a drive unit 22 which is in the form of an electric motor. Motor 22 rotates drum 18 using, e.g., a plurality of gears 23, 26 and 28 (FIG. 2). For purposes of illustration, the enmeshing teeth on the various gears within the image forming apparatus 10 are not shown. Motor 22 is electrically connected to and controlled by an electrical processor 30. Referring to FIG. 2, electrical processor 30 of course includes a plurality of electrical components, such as a microprocessor 32. Electrical processor 30 also includes an electrical connector 34, as will be described in more detail hereinafter.

Paper feed assembly 14 includes a conveying mechanism having a plurality of rollers 36, 38 (FIG. 1) for feeding a transfer sheet from a paper source such as a paper tray (not shown) to EP assembly 12. Rollers 36 are driven or feed rollers, while rollers 38 are back-up rollers. For simplicity sake, feed rollers 36 and back-up rollers 38 are only shown in FIG. 1. Feed rollers 36, as shown, are driven by gear 40 and other interconnecting gears (not shown). Other feed rollers (not shown for sake of simplicity) are driven by gears 42 and 44. All feed rollers will collectively be referred to as feed rollers 36.

Those skilled in the art will recognize that paper feed assembly 14 could include a sheet conveying mechanism other than the disclosed plurality of rollers. For example, the sheet could be conveyed by a single roller, or the plurality of rollers could be replaced, for example, by one or more belts, or one or more friction devices which engage the sheet.

Rollers 36, 38 define an input paper path therebetween through which a transfer sheet may pass while traveling to drum 18. The last feed roller 36 in the input paper path (indicated by arrow 51) defines a registration point at which a leading edge of a transfer sheet is aligned relative to a predetermined orientation of drum 18. For example, the registration point can be a point in the input paper path positioned relative to last roller 36 which is closest to drum 18, using a number of revolutions or steps of rollers 36, 38 or gears 40, 42, 44. Alternatively, a sensor may be positioned between last roller 36 and drum 18 to sense the leading edge of a transfer sheet passing therethrough.

According to one aspect of the present invention, a removable power transfer device 46 interconnects motor 22 with the plurality of feed rollers 36, via gears 40, 42 and/or 44. Removable power transfer device 46 is preferably in the form of an idler mechanism such as an idler gear which may be relatively easily installed and removed from between plates 48 (FIG. 1) and 50 (FIG. 2). When installed, idler gear 46 is held in place by stub shafts 47 which are located on opposing plates 48 and 50. Alternatively, idler gear 46 may be held in place using a conventional fastener which engages shaft 47 of either plate 48 or plate 50. When in an installed position as shown in FIGS. 1 and 2, motor 22 rotates gear 24, which drives idler gear 46, and in turn drives gear 40 of paper feed assembly 14.

Figure 3:
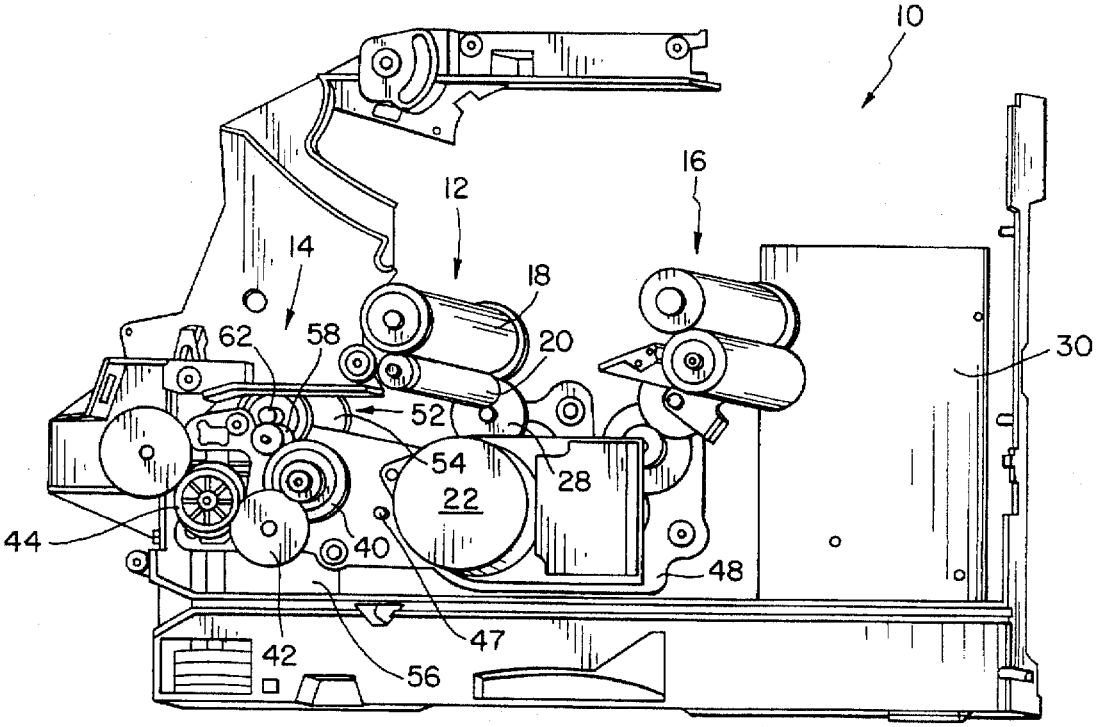
FIG. 3 is a perspective view of the image forming apparatus of FIGS. 1 and 2, with the removable idler gear removed therefrom, and an embodiment of the staging assembly of the present invention installed therein.
Figure 4:
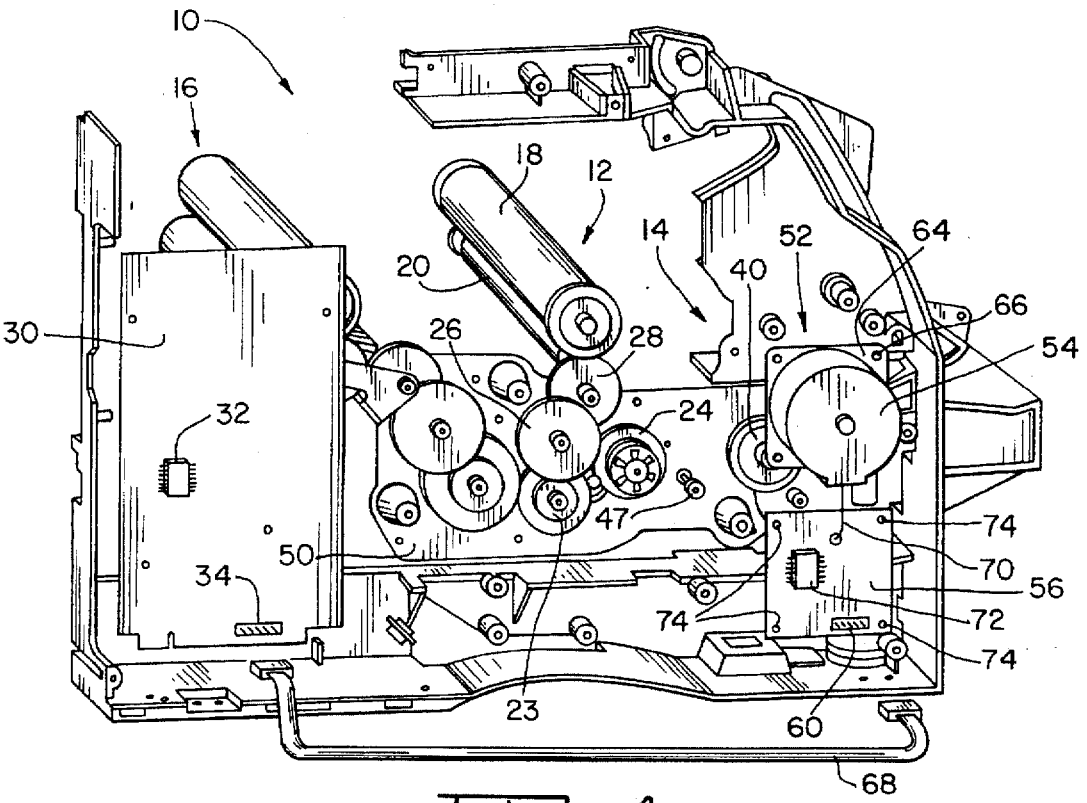
FIG. 4 is another perspective view of the image forming apparatus of FIG. 3.

Referring now to FIGS. 3 and 4, image forming apparatus 10 is shown with idler gear 46 removed therefrom. When idler gear 46 is removed, gear 24 connected to motor 22 no longer drives gear 40 of paper feed assembly 14. Rollers 36 which are disposed upstream from the registration point, relative to a direction of travel through input paper path 51 (FIG. 1), are decoupled from motor 22 when idler gear 46 is removed from image forming apparatus 10 as shown in FIGS. 3 and 4. Alternatively, the gear train may be configured such that the roller closest to drum 18, i.e., the registration roller, may remain coupled to motor 22, while the remainder of the rollers are decoupled from motor 22 when idler gear 46 is removed.

Figure 5:
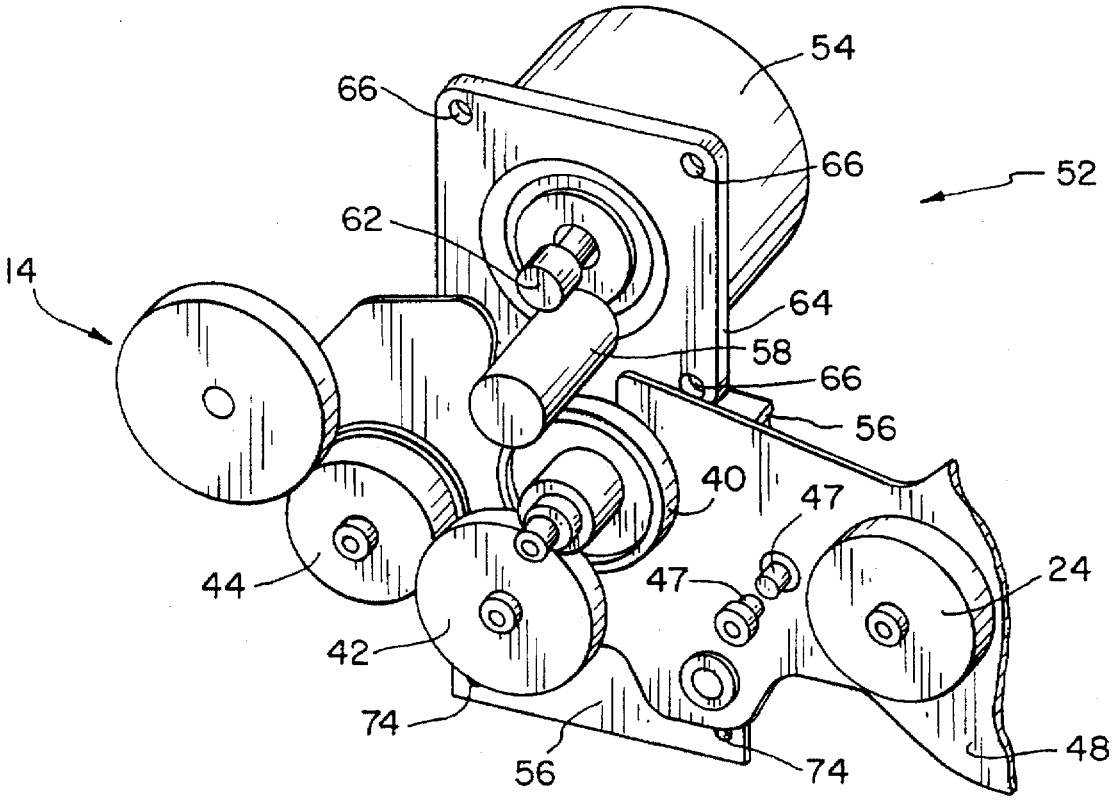
FIG. 5 is an enlarged, perspective view of the staging assembly, showing engagement with gears of the paper feed assembly.

Another aspect of the present invention is a modular staging assembly 52 (FIGS. 3–5) which may be used to rotatably drive gears 40, 42, 44 and feed rollers 36 when idler gear 46 is removed from image forming apparatus 10. Staging assembly 52 generally includes a drive unit 54, electrical processor 56, rotatable drive element 58, and electrical connector 60.

Drive unit 54 rotatably drives rotatable drive element 58. In the embodiment shown, drive unit 54 is an electric staging motor and rotatable drive element 58 is an idler gear which is attached to motor 54. Motor 54 includes an output shaft 62 which engages and drives idler gear 58. Motor 54 is selectively operable at one of a plurality of speeds, and is controlled by an electrical processor 56. Motor 54 also includes a flange 64 (FIG. 4) having holes 66 through which bolts or the like (not shown) may extend to fasten motor 54 to image forming apparatus 10.

Electrical processor 56 is connected to and in electrical communication with electrical processor 30. More particularly, electrical processor 56 is connected to electrical processor 30 using a multi-line conductor 68, such as a jumper cable or bus, which attaches at opposite ends thereof to respective electrical connectors 60, 34. In a preferred embodiment, jumper cable 68 and electrical connectors 60, 34 define a serial connection between electrical processor 56 and electrical processor 30. Electrical processor 56 also includes a plurality of electrical components such as a microprocessor 72 and associated hardware (not shown). Electrical processor 56 is connected to a suitable framework of image forming apparatus 10 using fasteners (not shown) which pass through mounting holes 74.

Electrical processor 56 is used to control motor 54, and thereby in turn control rotation of feed rollers 36 (FIG. 1). To that end, electrical processor 56 is connected to motor 54 via a conductor 70. As indicated above, motor 54 is selectively operable at one of a plurality of speeds. Electrical processor 56 controls the speed of operation of motor 54 by sending a signal via conductor 70. Such a signal may be analog or digital, and may contain one or more pieces of data or con, hands, depending upon the requirements of motor 54.

Figure 6:
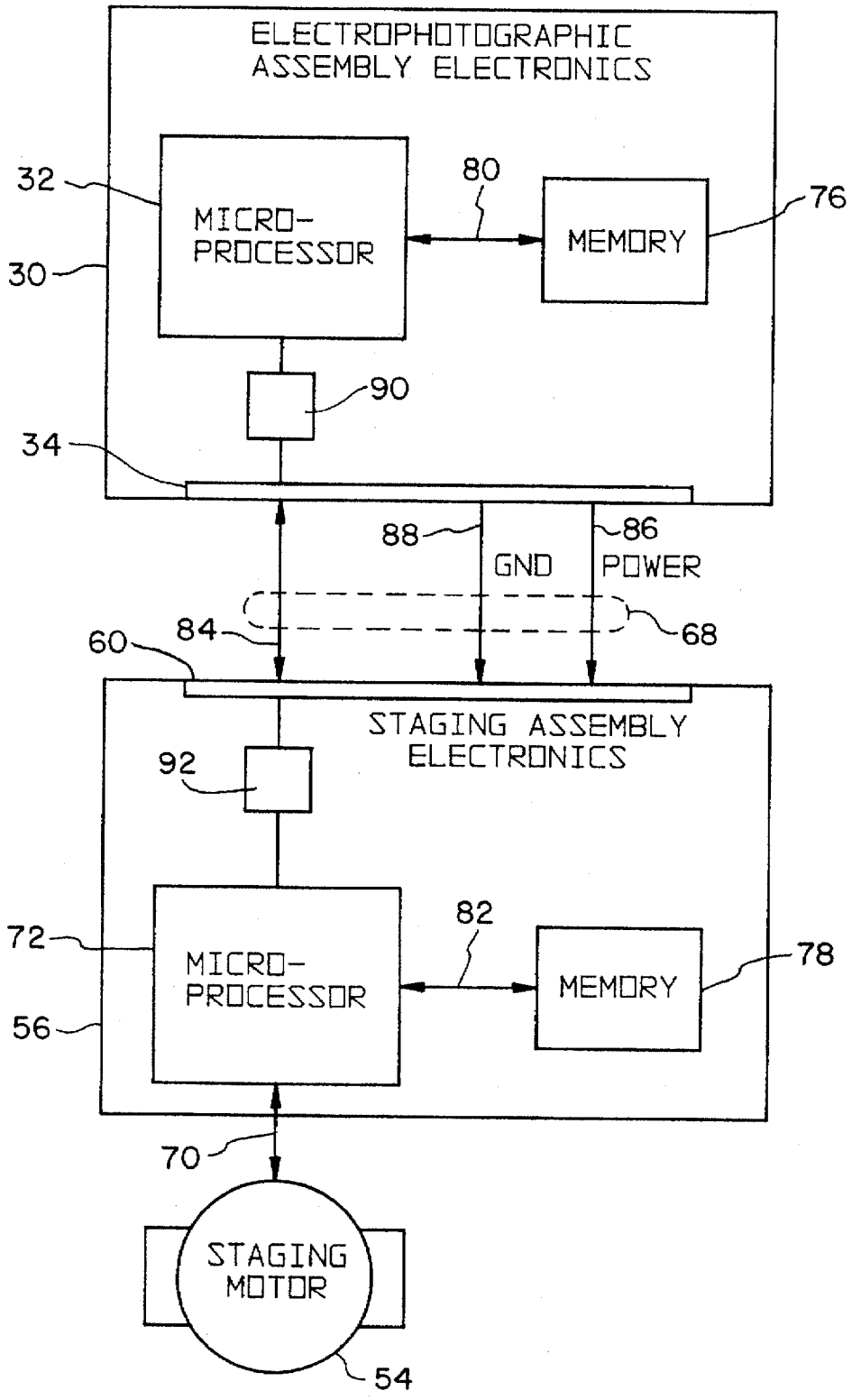
FIG. 6 is a schematical, block diagram showing interconnection and comminication between the electrical processors of the EP assembly and the staging assembly.

FIG. 6 is a schematical, block diagram of the electrical interconnection and communication between electrical processor 30, electrical processor 56 and drive unit or staging motor 54. Electrical processor 56 receives power and ground from electrical processor 30 over conductors 86, 88, respectively. Electrical processors 30, 56 each include a microprocessor 32, 72, respectively, as indicated above. Microprocessors 32, 72 are connected with each other via conductors 84 and associated interface circuits 90 and 92, respectively. Conductors 84, 86, 88 may form a part of jumper cable 68 (FIG. 4). Also, conductor 84 may be a single or multi-conductor cable or bus, depending upon such factors as whether serial or parallel data is to be exchanged between microprocessors 32 and 72.

Microprocessor 32 is connected and in two-way communication with non-volatile memory 76 via bus 80. Memory 76 includes information such as operating parameters which are transmitted to microprocessor 72 for control of staging motor 54. For example, memory 76 may include information pertaining to an operating speed at which staging motor 54 operates, or a number of steps which staging motor 54 is to increment through (corresponding to a predetermined distance) prior to stopping. The operating speed and distance stored in memory 76 which are used to control staging motor 54 may vary from one model printer to another, and thus staging assembly 56 may be removably installed in a number of different model printers. Moreover, memory 76 may include a plurality of operating speeds at which staging motor 54 is to operate, depending upon a particular resolution of print which is selected by a user.

Microprocessor 72 receives information from memory 76 via microprocessor 32, and is also connected and in two-way communication with non-volatile memory 78 via bus 82. Memory 78 may include varying amounts of information used by microprocessor 72 for controlling motor 54, depending on the sophistication of electrical processor 56. For example, memory 78 may include information such as operating system commands, self check algorithms and data, look-up tables indicating how to step motor 54, etc. Microprocessor 72 may receive information from memory 78 and/or microprocessor 32, and controls staging motor 54 by transmitting appropriate signals over conductor 70 connected therebetween. Motor 54 is preferably controlled such that a through-put rate through paper feed assembly 14 is approximately the same as a through-put rate through EP assembly 12. Although microprocessors 32 and 72 are shown separate from associated memories 76 and 78, respectively, those skilled in the art will recognize that microprocessor units are commercially available which include both the microprocessor and memory in a single package.

Figure 7:
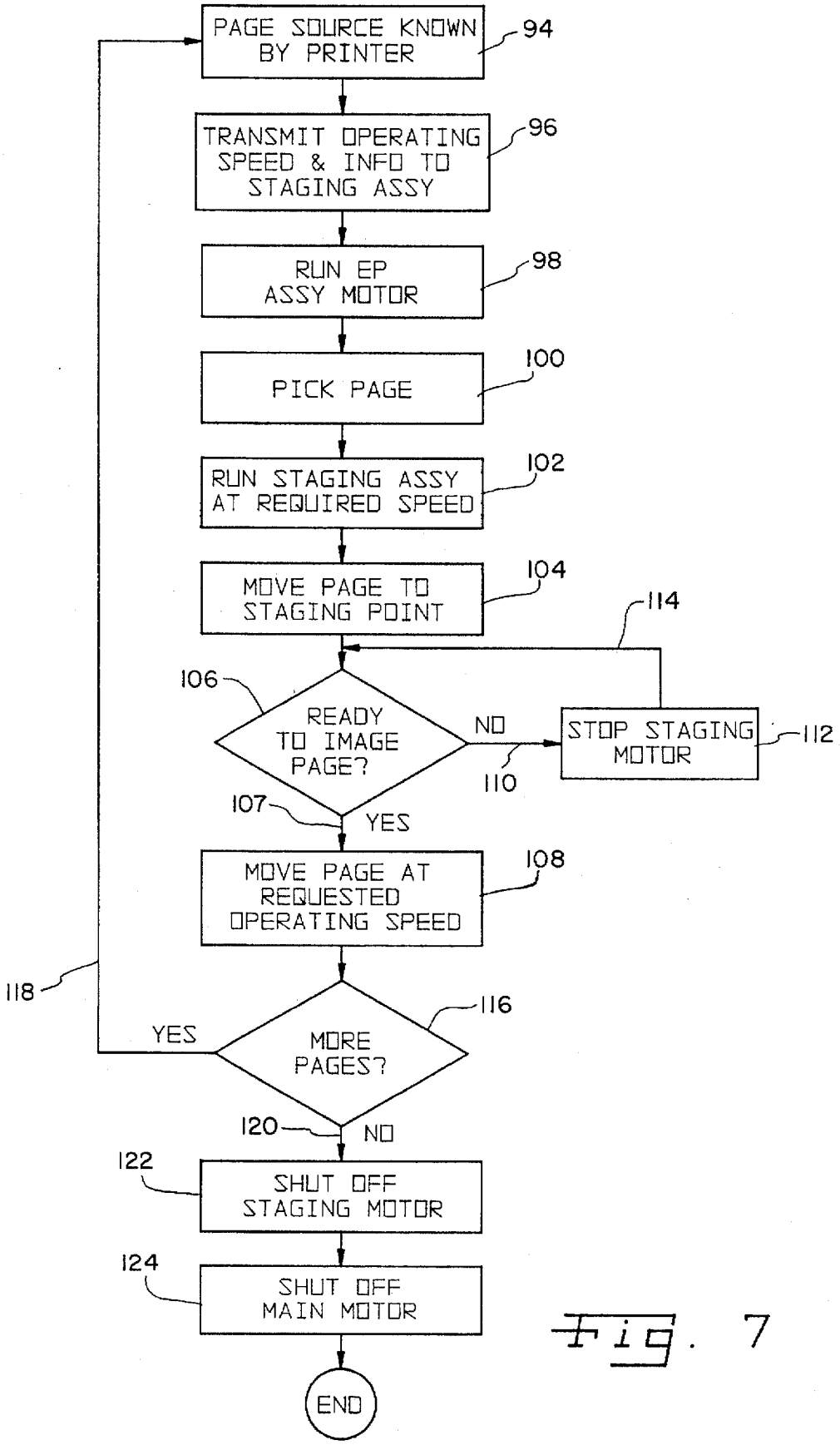
FIG. 7 is a flowchart illustrating a portion of the electrical communications between the electrical processor of the EP assembly and the electrical processor of the staging assembly.

FIG. 7 illustrates a portion of the logic exchange between electrical processor 30 and electrical processor 56. At block 94, a page source such as a particular tray or manual feed location is determined by image forming apparatus 10 using, a signal received from an external computer or a manual switch. After determination of the page source, the operating speed and other information such as additional operating parameters are transmitted by electrical processor 30 to electrical processor 56 (block 96). Electrical processor 30 controls motor 22 (block 98) which is run at a particular operating speed depending upon the particular model, print resolution, etc. Electrical processor 30 also provides a signal which causes a page to be picked from the particular page source (block 100). Thereafter, electrical processor 56 of staging assembly 52 controls operation of staging motor 54, such that motor 54 runs at a predetermined speed relative to motor 22 (block 102). The page is moved by paper feed assembly 14 to the staging point in input paper path 51 (block 104). The staging point may be at or near the registration point disposed in association with the last feed roller 36 in input paper path 51, as described above. If EP assembly 12 is ready to image the page located at the staging point, such as indicated by line 107 of decision block 106, then the page is moved at the requested operating speed (block 108) into EP assembly 12. On the other hand, if EP assembly 12 is not ready to image the page located at the staging point (line 110) then staging motor 54 is stopped (block 112). In one embodiment of the invention, electrical processor 56 simply waits for a signal to be transmitted thereto from electrical processor 30 indicating that EP assembly 12 is ready for the next page. Thus, in essence a flow control loop is formed while electrical processor 56 is waiting to receive a signal from electrical processor 30 indicating that the next page can be sent, as indicated by lines 110, 114 and block 112.

After the page is moved into EP assembly 12 at the requested operating speed and in registration with drum 18, electrical processor 30 of EP assembly 12 makes a determination as to whether additional pages are to be printed (block 116). If the answer is YES (line 118), the process passes control back to block 94. Conversely, if no additional pages remain to be printed (line 120), then staging motor 54 and EP assembly motor 22 are each shut off (blocks 122, 124).

The installation of modular staging assembly 52 within image forming apparatus 10 will now be briefly described: During assembly, image forming apparatus 10 may be assembled with removable idler gear 46 disposed between EP assembly 12 and paper feed assembly 14. When idler gear 46 is installed, modular staging assembly 52 is not disposed within image forming apparatus 10. However, certain users may desire the advantages which staging offers such as increased through-put rate through image forming apparatus 10. Accordingly, idler gear 46 may be removed from image forming apparatus 10, at which point motor 22 no longer drives gear 40 of paper feed assembly 14. Modular staging assembly 52 is inserted into image forming apparatus 10 and connected to suitable framework such that idler gear 58 enmeshes with gear 40. Jumper cable 68 is connected to electrical connectors 34, 60 of electrical processors 30, 56, respectively. Information may then be transmitted in either direction between electrical processor 30 and electrical processor 56 over jumper cable 68. Upon receiving appropriate signals from electrical processor 30, as described above with reference to the flow chart of FIG. 7, electrical processor 56 then controls motor 54 to drive feed rollers 36.

From the preceding discussion, it is apparent that either a removable power transfer device 46 or a second drive unit 54 is used to rotatably drive a number of the plurality of feed rollers 36. Removable power transfer device 46 and second drive unit 54 therefore alternatively define an input power device which is coupled to and drives a number of feed rollers 36. Removable power transfer device 46 and drive unit 54 are not simultaneously used within image forming apparatus 10, but rather are alternatively used to provide input power to paper feed assembly 14.

In the embodiment shown in the drawings, power transfer device 46 interposed between EP assembly 12 and paper feed assembly 14 is in the form of an idler gear. However, it is also to be understood that power transfer device 46 may take the form of a different structure which is relatively easily removable from image forming apparatus 10 and capable of transferring power from EP assembly 12 to paper feed assembly 14. For example, it may be possible to construct an equivalent power transfer device 46 in the form of belts, pulleys, chains and/or slide arms or the like which are removably installed in image forming apparatus 10.

Further, in the embodiment shown in the drawings, motor 54, output shaft 62 and drive element 58 are shown as an integral unit, while electrical processor 56 is disposed separate from motor 54 and connected thereto via line 70. However, it is also to be understood that drive unit 54 and electrical processor 56 may be formed as an integral unit which is attached to suitable framework of image forming apparatus 10.

Moreover, in the embodiment shown in the drawings, idler gear 58 engages gear 40 of paper feed assembly 14. However, it is also possible to configure output shaft 62 to directly engage gear 40, or to use other structures such as belts or the like to transfer power from motor 54 to gear 40.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An image forming apparatus, comprising:

an electrophotographic assembly including a photosensitive element and a first drive unit for rotating said photosensitive element;

a paper feed assembly including a mechanism for conveying a transfer sheet to said photosensitive element; and an input power device coupled to said mechanism, said input power device being installable into said image forming apparatus, said input power device selectively comprising one of:

a removable power transfer device interconnecting said first drive unit to said mechanism when installed in said image forming apparatus; and a second drive unit coupled to said mechanism when installed in said image forming apparatus.

2. The image forming apparatus of claim 1, wherein said removable power transfer device comprises an idler mechanism.

3. The image forming apparatus of claim 1, wherein said removable power transfer device comprises a gear.

4. The image forming apparatus of claim 1, wherein said second drive unit comprises a modular assembly.

5. The image forming apparatus of claim 1, wherein said second drive unit is electrically connected to said first drive unit.

6. The image forming apparatus of claim 1, wherein said second drive unit comprises an electrical processor in electrical communication with said first drive unit.

7. An image forming apparatus, comprising:

an electrophotographic assembly including a photosensitive element and a first drive unit for rotating said photosensitive element, said electrophotographic assembly including a first electrical processor; and a paper feed assembly including a plurality of rollers for feeding a transfer sheet to said electrophotographic assembly, said paper feed assembly including a second drive unit for rotating said rollers, said paper feed assembly further including a second electrical processor which is in electrical communication with said first electrical processor, said second drive unit being operable dependent upon said electrical communication between said first and second electrical processors.

8. The image forming apparatus of claim 7, further comprising a removable staging assembly including a rotatable drive element connected to one of said rollers, a drive unit for rotatably driving said rotatable drive element, and an electrical connector for electrically connecting said staging assembly to said electrophotographic assembly.

9. The image forming apparatus of claim 7, wherein said electrical communication comprises a signal representing an operating parameter of said second drive unit.

10. The image forming apparatus of claim 7, wherein said second electrical processor includes a non-volatile memory.

11. A staging assembly for use in an image forming apparatus, the image forming apparatus including a paper feed assembly having a plurality of rollers for feeding a transfer sheet to an electrophotographic assembly, said staging assembly comprising:

a drive unit for connection to and rotation of one of the rollers; and an electrical connector for electrically connecting said staging assembly to the electrophotographic assembly;

said staging assembly comprising a modular assembly which is connectable to and removable from the paper feed assembly.

12. The staging assembly of claim 11, further comprising an electrical processor connected to said electrical connector, said electrical processor controlling operation of said drive unit.

13. The staging assembly of claim 12, wherein said drive unit is selectively operable at one of a plurality of speeds, said electrical processor controlling said selected speed.

14. The staging assembly of claim 11, wherein said drive unit comprises a motor having a rotatable output shaft, and a rotatable drive element coupled to said output shaft.

15. The staging assembly of claim 11, wherein said drive unit comprises an output shaft, and an idler gear engaged with said output shaft.

16. The staging assembly of claim 11, wherein said electrical connector comprises a serial connector.

17. An image forming apparatus, comprising:

an electrophotographic assembly including a photosensitive element and a drive unit for rotating said photosensitive element;

a paper feed assembly including a plurality of rollers for feeding a transfer sheet to said electrophotographic assembly, said plurality of rollers defining a paper path through which the transfer sheet may pass, one of said rollers defining a registration point in said paper path; and a removable power transfer device interconnecting said drive unit to said plurality of rollers when in an installed position, and decoupling said drive unit from said plurality of rollers when in a removed position, wherein said rollers which are disposed upstream from said registration point, relative to a direction of travel through the paper path, are decoupled from said drive unit when said power transfer device is in said removed position.

18. The image forming apparatus of claim 17, wherein said removable power transfer device comprises an idler gear.

19. A method of transporting a transfer sheet through a paper feed assembly in an image forming apparatus, comprising the steps of:

providing an electrophotographic assembly including a photosensitive element, a first drive unit connected to said photosensitive element, and a first electrical processor;

providing a paper feed assembly including a plurality of rollers for feeding a transfer sheet to said electrophotographic assembly, said paper feed assembly including a second drive unit for rotating said rollers, said paper feed assembly further including a second electrical processor which is in electrical communication with said first electrical processor;

sending a signal from said first electrical processor to said second electrical processor corresponding to an operating parameter of said second drive unit;

rotating the photosensitive element using said first drive unit; and operating said second drive unit dependent on said signal.

20. The method of claim 19, wherein said operating parameter comprises an operating speed of said second drive unit.

21. The method of claim 19, wherein said operating step comprises operating said second drive unit such that a through-put rate through said paper feed assembly is approximately the same as a through-put rate through said electrophotographic assembly.

22. The method of claim 19, wherein said rotating step comprises selectively rotating said photosensitive element at one of a plurality of operating speeds.

23. The method of claim 19, comprising the further step of sending a further signal from said first electrical processor to said second electrical processor corresponding to an additional operating parameter, said operating step being dependent upon said additional operating parameter.

24. The method of claim 23, wherein said additional operating parameter corresponds to a distance, and comprising the further step of stopping said second drive unit dependent on said distance.

25. The method of claim 19, comprising the further step of stopping said second drive unit after said operating step, while said rotating step is being carried out.

26. The method of claim 19, wherein said sending step occurs before said rotating step.

27. An image forming apparatus, comprising:

an electrophotographic assembly including a photosensitive element and a first drive unit for rotating said photosensitive element;

a paper feed assembly including a plurality of rollers for conveying a transfer sheet to said photosensitive element; and a removable power transfer device interconnecting said first drive unit to a number of said plurality of rollers when in an installed position, and decoupling said first drive unit from said number of said plurality of rollers when in a removed position, wherein after said removable power transfer device is in the removed position, a second drive unit is coupled to said number of said plurality of rollers to operate said number of said plurality of said rollers.

28. The image forming apparatus of claim 27, wherein said removable power transfer device comprises an idler mechanism.

29. The image forming apparatus of claim 27, wherein said second drive unit is electrically connected to said first drive unit.

* * * * *